US005302033A

United States Patent [19]

Matsumoto et al.

[11] Patent Number: 5,302,033

[45] Date of Patent: Apr. 12, 1994

[54] BURNING DAMAGE PROTECTING APPARATUS AND METHOD FOR A PRINTING HEAD IN A PRINTER

[75] Inventors: Hisayoshi Matsumoto, Hidaka; Takeya Uehara, Tokyo, both of Japan

[73] Assignee: Citizen Watch Co., Ltd., Tokyo, Japan

[21] Appl. No.: 849,560

[22] Filed: Mar. 11, 1992

[30] Foreign Application Priority Data

Mar. 26, 1991 [JP] Japan ..... 3-084389

[51] Int. Cl.[5] ..... B41J 29/38; B41J 2/30

[52] U.S. Cl. ..... 400/54; 400/74; 400/124; 400/703

[58] Field of Search ..... 400/54, 74, 124, 121, 400/703, 711; 101/93.05, 93.04

[56] References Cited

FOREIGN PATENT DOCUMENTS

| | | | |
|---|---|---|---|
| 0396343 | 4/1990 | European Pat. Off. . | |
| 57-128566 | 8/1982 | Japan . | |
| 59-5544 | 1/1984 | Japan . | |
| 0059464 | 4/1984 | Japan | 400/54 |
| 0104956 | 6/1984 | Japan | 400/54 |
| 59-109381 | 6/1984 | Japan . | |
| 0002570 | 1/1986 | Japan | 400/54 |
| 61-92876 | 5/1986 | Japan . | |
| 0042861 | 2/1987 | Japan | 400/54 |
| 62-62771 | 3/1987 | Japan . | |
| 62-122761 | 6/1987 | Japan . | |
| 63-69658 | 3/1988 | Japan . | |

OTHER PUBLICATIONS

Research Disclosure "Wire Matrix Printhead Driver Short Detect System" (Jan. 1989).

*Primary Examiner*—Edgar S. Burr
*Assistant Examiner*—Christopher A. Bennett
*Attorney, Agent, or Firm*—Lowe, Price, LeBlanc & Becker

[57] ABSTRACT

A burning damage protecting apparatus and method for a printing head in a printer comprising a printing head actuating circuit having a driver and a coil, a headpin-driver actuating electric power source which is connected to the printing head actuating circuit, a voltage monitor connected to the headpin-driver actuating electric power source, and a micro processing unit connected to each of the printing head actuating circuit, the headpin-driver actuating electric power source, and the voltage monitor; in which, the micro processing unit turns on the headpin-driver actuating electric power source for a first predetermined short time and subsequently turns it off immediately after the printer is turned on, and measures a voltage based on a signal fed from the voltage monitor at the timing the headpin-driver actuating electric power source is turned off, and then measures a voltage in the same manner as above measurement after a second predetermined short time has elapsed, still further judges whether the driver is normal or not based on the difference between the voltage at the timing the first predetermined time has elapsed and the voltage at the timing the second predetermined time has elapsed, and consequently prevents electric current from flowing in the coil by not turning on the headpin-driver actuating electric power source when an abnormal condition is detected.

16 Claims, 3 Drawing Sheets

BURNING DAMAGE PROTECTING APPARATUS AND METHOD FOR A PRINTING HEAD IN A PRINTER

BACKGROUND OF THE INVENTION

1. Field of the Invention

The present invention relates to a burning damage protecting apparatus and method for a coil actuating a printing head in a printer.

2. Description of the Prior Art

In a conventional printer, a printing needle of the printing head is actuated by a solenoid. The solenoid includes a coil which is actuated by a driver. Printing operation in a printer is thus carried out by selectively actuating the driver. In such a driver actuating circuit for actuating a printing needle of the printing head, there was problem such that, when the driver is short-circuited, the coil is subjected to long-lasting continued electric current supply, thus resulting in a burning damage of the coil.

For this reason, there has been conventionally known a method detecting an abnormal condition as shown in the Japanese Unexamined Patent Application SHO 61-92876 in which a temperature detecting circuit detects an abnormal condition of the printing head before temperature of the heated coil generated in accordance with its operation reaches a dangerous temperature inducing a burning damage of the coil. Or, the Japanese Unexamined Patent Application SHO 59-5544 discloses a method in which a fuse provided in the driver actuating circuit opens the circuit when it is melted by temperature increase in the driver circuit.

Furthermore, regarding a method detecting a snapping of coil of the solenoid and non-conductivity of the driver in the driver actuating circuit, there has been known a method as disclosed in the Japanese Unexamined Patent Application SHO 59-109381, in which a connecting point between a coil and a driver of the solenoid is grounded through a large resistance, and there are provided a low-level detecting circuit for prioritizing a detection of low level signals and a high-level detecting circuit for prioritizing a detection of high level signals.

The detection of the snapping of coils is made on the basis of the output signal obtained when all the drivers are switched into an OFF-mode. On the contrary, the detection of the driver non-conductivity is made on the basis of the output signal obtained when all the drivers are switched into an ON-mode.

According to such conventional methods, it was possible to prevent coils actuating printing heads from burning by detecting abnormal conditions of the drivers and/or the coils during the printing operation of the printer. However, it was not possible to detect the abnormal condition of the driver before initiating the printing operation even if the printer is turned on.

SUMMARY OF THE INVENTION

It is therefore an object of the present invention, in order to resolve the aforementioned problems and disadvantages encountered in the art, to provide a burning damage protecting apparatus and method which is capable of preventing the coil of the printing head in the printer from burning by detecting in an early stage as to whether the driver is in a normal condition or an abnormal condition even when the driver is short-circuited.

To this end, according to the present invention, an electric power source supplies electric current to a headpin-driver actuating circuit, and this headpin-driver actuating electric power source is connected to a printing head actuating circuit in which a driver is comprised. A voltage monitor is connected to the headpin-driver actuating electric power source. The headpin-driver actuating electric power source is controlled to turn on for a short period of time in an early stage sufficiently before the burning damage is induced.

The voltage monitor detects the voltage as a first voltage when (or shortly after) the headpin-driver actuating electric power source is turned off after the elapse of said short period of time. And further, after predetermined time has passed, the voltage monitor detects the voltage as a second voltage in the same manner.

Then, it is judged whether or not the driver is normal or not on the basis of the voltage change from the first voltage at the timing or shortly after the timing that the headpin-driver actuating electric power source is turned off to the second voltage after a predetermined time has passed. When the judgement is abnormal, the headpin-driver actuating electric power source is surely prohibited from turning on, thereby protecting the coils from being subjected long-lasting continued electric current supply inducing a burning damage.

In accordance with a preferred embodiment of the present invention, this invention includes a micro processing unit (hereinafter, referred to as an MPU). When the MPU outputs a command signal, the headpin-driver actuating electric power source is turned on so as to be operative in response to this command signal. Then, if the MPU inputs a high-level signal to the driver, the driver initiates its operation. Upon the initiation of driver operation, electric current begins flowing from the headpin-driver actuating electric power source to the coil of the solenoid, so that the printing piece can be operated.

Before these operations, the MPU turns on the headpin-driver actuating electric power source for a short period of time and, subsequently, turns it off. And, the MPU inputs and memorizes a voltage of the headpin-driver actuating electric power source which is detected by the voltage monitor, and further repeats the same operations after a predetermined time elapses. Then the MPU compares the two voltages detected by the voltage monitor in this fashion. Further, the MPU judges whether the driver is in a normal condition or an abnormal condition based on the detected voltage change of the headpin-driver actuating electric power source. And, in the case that the judgement is abnormal, the MPU does not turn on the headpin-driver actuating electric power source.

The above and other objects, features and advantages of the present invention will become more apparent from the following detailed description which is to be read in conjunction with the accompanying drawings.

DETAIL DESCRIPTION OF THE PREFERRED EMBODIMENT

Figure 1:
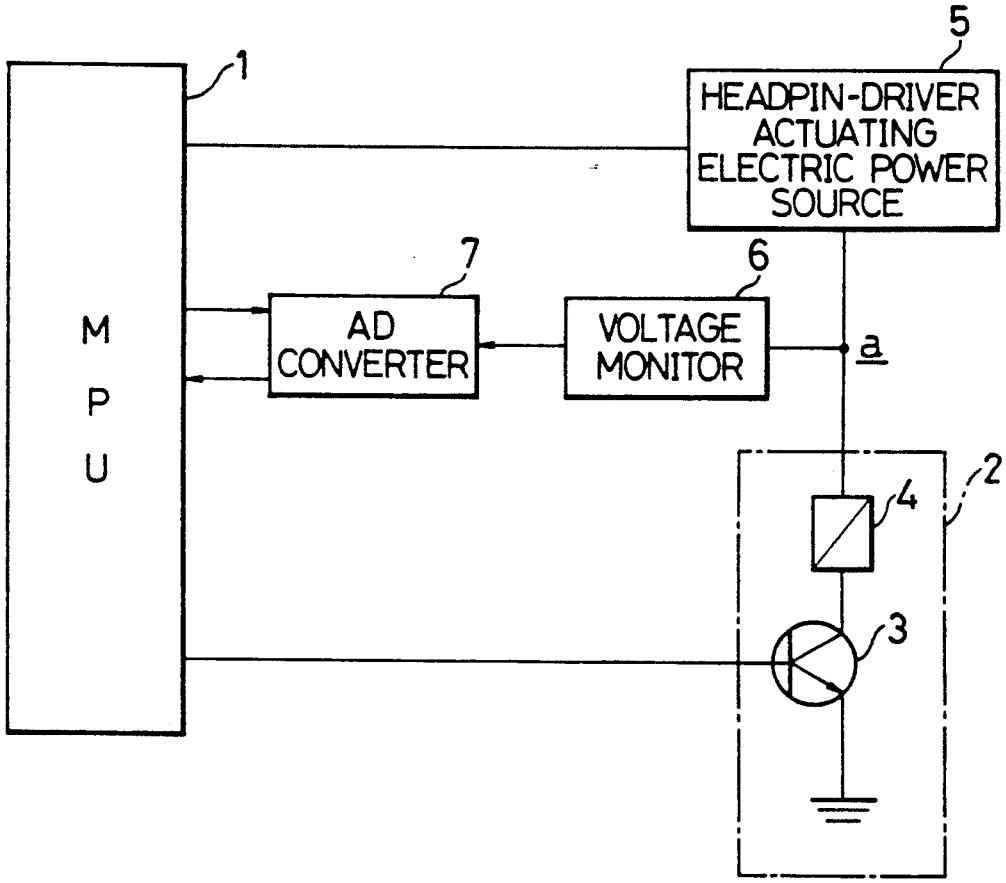
FIG. 1 is a block diagram showing a burning damage protecting apparatus for a printing head in a printer.

Hereinafter, referring now to the accompanying drawings, the preferred embodiment of the present invention is explained in detail. In FIG. 1, there is provided a micro processing unit 1 (hereinafter, referred to as an MPU 1), which is associated with a data processing unit such as a computer etc. (not shown). The MPU 1 serves as a printer control unit outputting control signals sequentially in accordance with data representing letters, figures and so on to be printed which are supplied from the data processing unit.

There is further provided a switching power transistor that serves as a driver 3 of a printing head actuating circuit 2. A base of the switching power transistor is connected to the MPU 1.

The printing head actuating circuit 2 is operative to give an impact on a printing piece disposed in the printing head. The printing head actuating circuit 2 includes a solenoid 4. And, a coil of the solenoid 4 is connected to a headpin-driver actuating electric power source 5 (DC 40 V) at one end, and connected to an emitter of the driver 3. A collector of the driver 3 is grounded.

A voltage monitor 6 is connected to a point a located between the printing head actuating circuit 2 and the headpin-driver actuating electric power source 5. The voltage monitor 6 is, in turn, connected to the MPU 1 via an AD converter 7. Moreover, the headpin-driver actuating electric power source 5 is connected to the MPU 1 so as to be on-off controlled by the MPU 1.

Accordingly, when the driver 3 is turned on upon a high-level signal inputting to a base of the driver 3, electric current begins flowing throughout the solenoid 4, thereby giving an impact on the printing piece (i.e. a printing needle).

Figure 2:
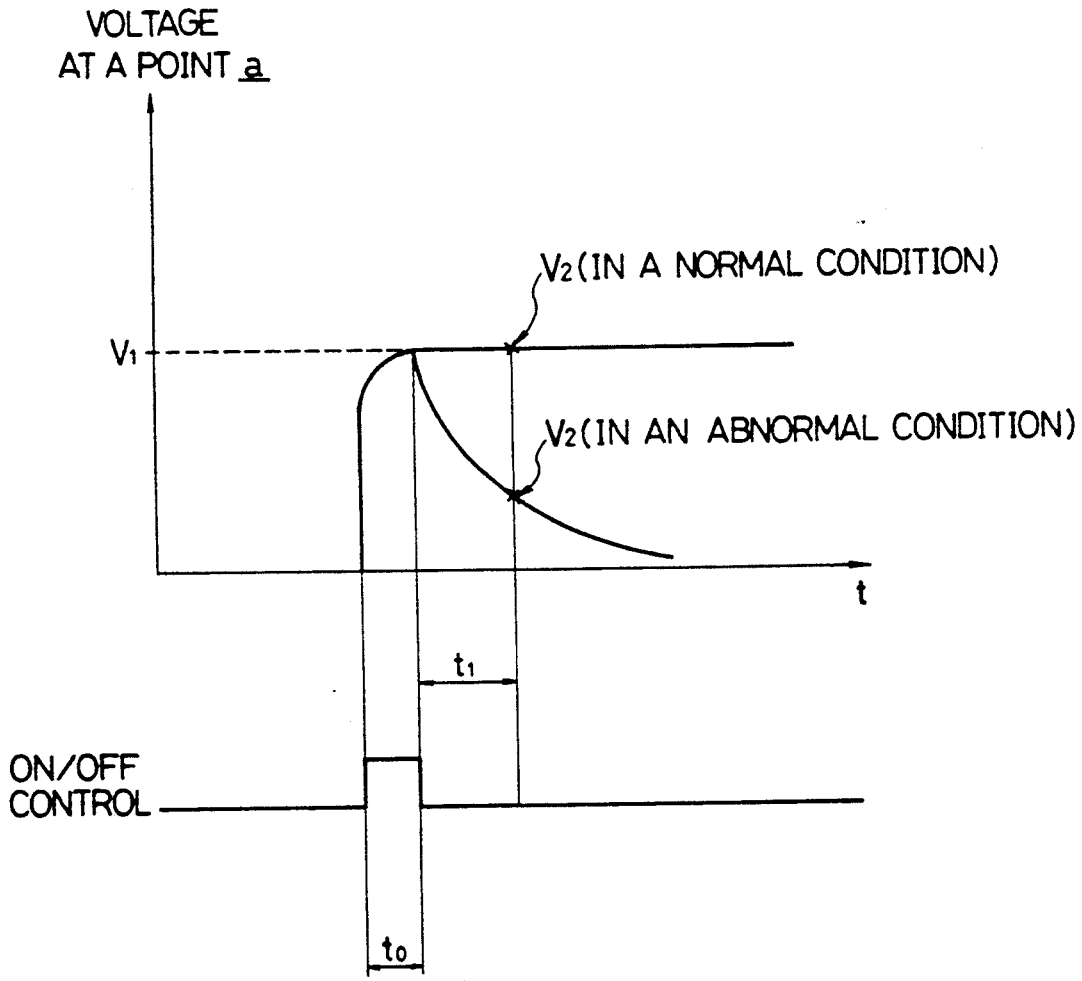
FIG. 2 is a time chart illustrating a voltage change with respect to an elapse of time in both normal and abnormal cases as a result of measurement in an embodiment of the present invention.

As shown in FIG. 2, shortly after the printer is turned on, the MPU 1 turns on the headpin-driver actuating electric power source 5 (DC 40 V) for a significantly short period of time and, subsequently, turns off it. And, at the same timing or shortly after the timing that the headpin-driver actuating electric power source 5 is turned off, the MPU 1 sends a signal to the AD convertor 7. The AD convertor 7 transduces a voltage detected at a position a and inputted through the voltage monitor 6 into a digital signal, and feeds the digital signal to the MPU 1. Thus, a voltage V1 is measured as a voltage at a position a obtained at the timing the headpin-driver actuating electric power source 5 is turned off.

Next, after a predetermined time t1 has elapsed, the MPU 1 sends a signal to the AD converter 7 to measure a voltage V2 at a position a, and carries out the measurement in the same manner as the above-mentioned method. Then, the MPU 1 judges as to whether the driver 3 is short-circuited or not on the basis of the difference between the voltages V1 and V2, or the voltage change in a certain period of time derived from these voltage V1 and V2.

When the headpin-driver actuating electric power source 5 (DC 40 V) is turned on, a voltage at the position a reaches V1 in a short time, the headpin-driver actuating electric power source 5 is subsequently turned off. If the driver 3 is in a normal condition, the driver 3 is maintained in an OFF condition between its collector and emitter, therefore, no collector current flows. Consequently, the voltage V2 at the position a obtained after predetermined time has elapsed is usually equal to the voltage V1 at the timing the headpin-driver actuating electric power source 5 is turned off.

However, in the case that the driver 3 is short-circuited; that is, the driver 3 is short-circuit between its collector and emitter, electric current flows rapidly in a short time. Therefore, the voltage at the point a steeply decreases. Accordingly, the voltage V2 obtained after predetermined time t1 becomes fairly small value compared with the voltage V1. Namely, it is judged that the driver 3 is not short-circuited if the difference between the voltage V1 and V2 is small, and to the contrary, the driver 3 is short-circuited if the difference is large.

The MPU 1 controls the headpin-driver actuating electric power source 5 to turn on again only when the driver 3 is judged to be in a normal condition. In other words, the MPU 1 does not turn on the headpin-driver actuating electric power source 5 when the driver is in an abnormal condition.

In this manner, the MPU 1 judges whether the driver 3 is in a normal condition or in an abnormal condition before initiating the operation of the driver 3, thus, it becomes possible to prevent the coil of the solenoid 4 from being subjected long-lasting continued electric current supply, thereby protecting against burning damage.

Hereinafter, an operation of the MPU 1 is explained referring to FIGS. 3 and 4.

Figure 3:
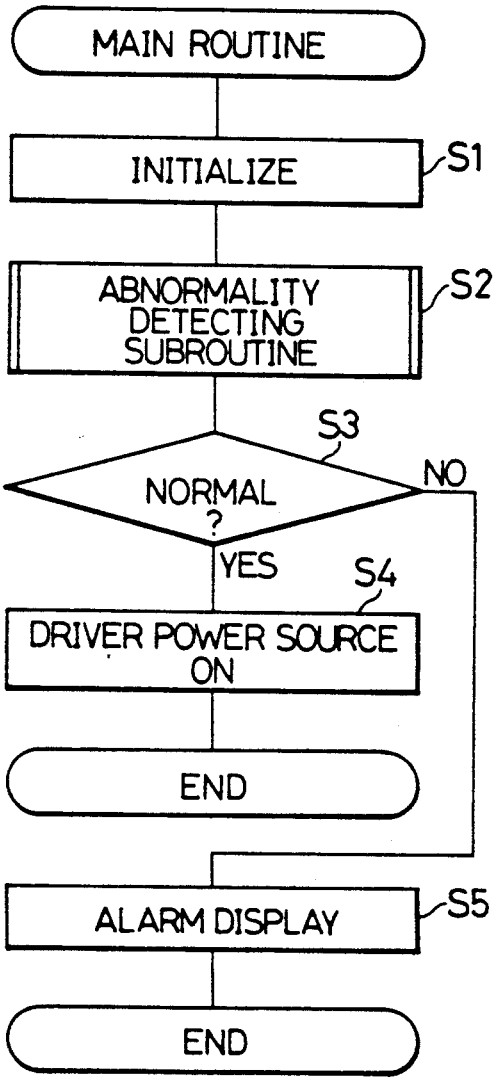
FIG. 3 is a flow chart explaining details of a main routine employed in the control of the present invention; and, FIG. 4 is a flow chart explaining details of a subroutine for detecting an abnormal condition of a headpin-driver employed in the control of the present invention.

FIG. 3 is a flow chart showing one embodiment of the main routine employed in the control of the MPU 1. First of all, all the control flags are initialized in a step S1, and then, a subroutine for detecting headpin-driver abnormality is carried out in a step S2. The details of the subroutine for detecting headpin-driver abnormality is described later referring to FIG. 4. If the subroutine for detecting headpin-driver abnormality is completed, it is judged as to whether or not the judgement in the above subroutine is normal in a step S3.

If the judgement is shown to be normal, the headpin-driver actuating electric power source 5 is turned on in a step S4. On the contrary, if the judgement is shown to be abnormal, not only the headpin-driver actuating electric power source 5 is not turned on but also an alarm display is actuated so that an operator can perceive the abnormal condition of the headpin driver in a step S5. If execution of above one complete cycle; i.e. from step S1 to step S5, is finished, the CPU 1 ends the main routine.

Figure 4:
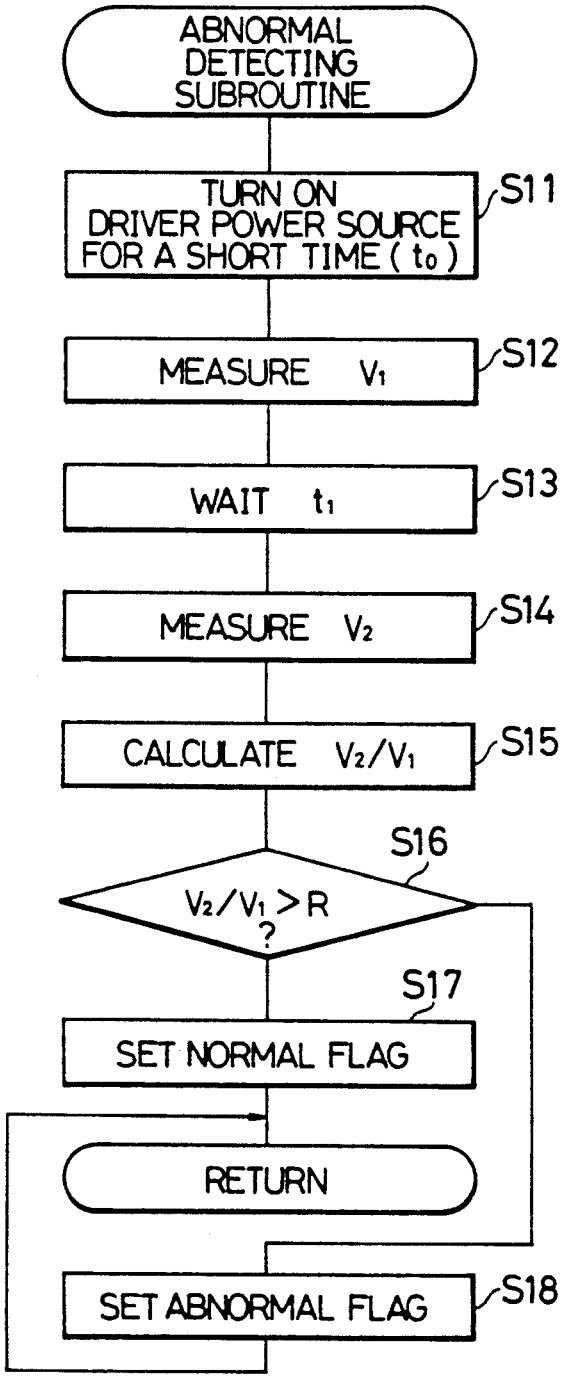

FIG. 4 shows the details of the subroutine for detecting abnormality of the headpin-driver which is employed in the control of the MPU 1. First of all, the headpin-driver actuating electric power source 5 is turned on for a significantly short period of time t0 and is, subsequently, turned off after time t0 has elapsed in a step S11. Then, the MPU 1 inputs a digital signal V1 through the AD convertor 7 from the voltage monitor 6 and stores it in a register R1 in the MPU 1 in a step S12.

Next, the MPU 1 sets a timer to t1 and waits until the set time t1 has elapsed in a step S13. If the time t1 has elapsed, the MPU 1 inputs a digital signal V2 through the AD convertor 7 from the voltage monitor 6 and stores it in a register R2 in the MPU 1 in a step S14.

Then, the MPU 1 calculates a ratio of the voltage V2 stored in the register R2 to the voltage V1 stored in the register R1 in a step S15. And it is judged in a next step S16 as to whether or not the ratio V2/V1 is greater than a predetermined reference value (r). If the result in the step S16 is shown that the ratio V2/V1 is greater than the predetermined reference value (r), the MPU 1 determines that the headpin-driver is in a normal condition and sets a normal flag in a step S17. This normal flag is utilized to perform the judgement in the step S3 of the main routine explained above.

To the contrary, if the result in the step S16 is shown that the ratio V2/V1 is not greater than the predetermined reference value (r), the MPU 1 determines that the headpin-driver is in an abnormal condition and sets an abnormal flag in a step S18. If execution of above one complete cycle; i.e. from step S11 to step S18, is finished, the CPU 1 ends the subroutine for detecting abnormality of the headpin-driver, and returns to the main routine.

Though the MPU is employed in the above embodiment, it is needless to say that the MPU can be substituted by other equivalent control means. Moreover, though the abnormal judgement is explained to be performed by obtaining a voltage drop within a predetermined period of time, it is possible to calculate a required time until the voltage drops a predetermined amount instead of above-described method.

As this invention may be embodied in several forms without departing from the spirit of essential characteristics thereof, the present embodiment is therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. A burning damage protecting apparatus for a printing head in a printer comprising:
- a printing head actuating circuit having a driver;
- a headpin-driver actuating electric power source connected to the printing head actuating circuit for supplying an electric current to the driver of the printing head actuating circuit;
- a voltage monitor connected to a connecting point of the printing head actuating circuit and the headpin-driver actuating electric power source for measuring a voltage at the connecting point; and
- a control means for
  - (i) once turning on the headpin-driver actuating electric power source for a predetermined short period and turning it off again under the condition that the driver of printing head actuating circuit is held in an OFF condition,
  - (ii) judging whether the driver of the printing head actuating circuit is normal or not based on a degree of voltage drop obtained from the voltage monitor by monitoring the voltage at the connecting point while function (i) is performed, and
  - (iii) prohibiting electric current supply to the printing head actuating circuit when judgement performed by function (ii) indicates that the driver is in an abnormal condition.

2. A burning damage protecting apparatus for a printing head in accordance with claim 1 in which said control means performs said judgement on the basis of a ratio of voltage drop at the connecting point within a predetermined period of time.

3. A burning damage protecting apparatus for a printing head in accordance with claim 2 in which said control means gives warning for indicating abnormal condition in addition to said electric current supply prohibition to the printing head actuating circuit.

4. The burning damage protecting apparatus of claim 1, wherein said printing head actuating circuit further includes a solenoid coupled to said driver and said headpin-driver actuating electric power source, and said voltage monitor is connected at the connecting point between said solenoid and said headpin-driver actuating electric power source.

5. A burning damage protecting apparatus for a printing head in a printer comprising:
- a printing head actuating circuit having a driver;
- a headpin-driver actuating electric power source connected to the printing head actuating circuit for supplying electric current to the driver of the printing head actuating circuit;
- a voltage monitor connected to a connecting point of the printing head actuating circuit and the headpin-driver actuating electric power source for measuring a voltage at the connecting point; and
- a judging means for
  - (i) once turning on the headpin-driver actuating electric power source for a predetermined short period and turning it off again under the condition that the driver of printing head actuating circuit is held in an OFF condition,
  - (ii) measuring a voltage drop by the voltage monitor occurring in the voltage at the connecting point of the printing head actuating circuit and the headpin-driver actuating electric power source during a predetermined short time from a first timing to a second timing, and
  - (iii) judging whether the driver of the printing head actuating circuit is normal or not by comparing the measured voltage drop with a predetermined reference value.

6. A burning damage protecting apparatus for a printing head in accordance with claim 5 in which said voltage drop at the connecting point is calculated based on a ratio of voltages measured by setting a predetermined time interval therebetween.

7. A burning damage protecting apparatus for a printing head in accordance with claim 6 further comprising an abnormal control means for prohibiting an electric current supply to the printing head actuating circuit and giving a warning to indicate abnormal condition when the said judging means shows that the driver is in an abnormal condition.

8. The burning damage protecting apparatus of claim 5, wherein said printing head actuating circuit further includes a solenoid coupled to said driver and said headpin-driver actuating electric power source, and said voltage monitor is connected at the connecting point between said solenoid and said headpin-driver actuating electric power source.

9. A burning damage protecting apparatus for a printing head in a printer comprising:
- a printing head actuating circuit having a driver and a coil;
- a headpin-driver actuating electric power source which is connected to the printing head actuating circuit;
- a voltage monitor connected to the headpin-driver actuating electric power source; and a micro processing unit connected to each of the printing head actuating circuit, the headpin-driver actuating electric power source, and the voltage monitor; in which, said micro processing unit includes means for turning on the headpin-driver actuating electric power source for a first predetermined short time and subsequently turning it off immediately after the printer is turned on, and measuring a first voltage based on a signal fed from the voltage monitor at the timing the headpin-driver actuating electric power source is turned off, said micro processing unit further includes means for measuring a second voltage in the same manner as said first voltage after a second predetermined short time has elapsed, means for judging whether the driver is normal or not based on the difference between the first voltage at the timing the first predetermined time has elapsed and the second voltage at the timing the second predetermined time has elapsed, and means for preventing electric current from flowing in the coil by not turning on the headpin-driver actuating electric power source when an abnormal condition is detected.

10. The burning damage protecting apparatus on claim 9, wherein said printing head actuating circuit further includes a solenoid coupled to said driver and said headpin-driver actuating electric power source, and said voltage monitor is connected at the connecting point between said solenoid and said headpin-driver actuating electric power source.

11. A burning damage protecting method for a printing head in a printer having a printing head actuating circuit with a driver and a coil, a headpin-driver actuating electric power source which is connected to the printing head actuating circuit and supplies electric current to the driver, and a voltage monitor connected to a connecting point of the printing head actuating circuit and the headpin-driver actuating electric power source for measuring a voltage at the connecting point; said burning damage protecting method comprising the steps of:

once turning on the headpin-driver actuating electric power source for a predetermined short period of time immediately after the printer is turned on, and turning it off again;

measuring a voltage by inputting a signal from the voltage monitor;

again measuring a voltage by inputting a signal from the voltage monitor after a predetermined time has elapsed;

judging whether the driver is normal or not by comparing a voltage change derived from the difference between said detected two voltages with a predetermined reference value; and prohibiting electric current supply to the coil by not turning on the headpin-driver actuating electric power source when the abnormal condition is detected.

12. A burning damage protecting method for a printing head in accordance with claim 11 in which said voltage change is calculated based on a ratio of voltages measured by setting a predetermined time interval therebetween.

13. A burning damage protecting method for a printing head in accordance with claim 12 further comprising a step of giving a warning to indicate abnormal condition in addition to electric current supply prohibition to the printing head actuating circuit when said judging step shows that the driver is in an abnormal condition.

14. A burning damage protecting method for a printing head in a printer having a printing head actuating circuit with a driver, a headpin-driver actuating electric power source which is connected to the printing head actuating circuit and supplies electric current to the driver, and a voltage monitor connected to a connecting point of the printing head actuating circuit and the headpin-driver actuating electric power source for measuring a voltage at the connecting point; said burning damage protecting method comprising the steps of:

turning on the headpin-driver actuating electric power source under the condition that the printing head actuating circuit is held in an OFF-condition;

turning off the headpin-driver actuating electric power source after a predetermined time;

measuring a voltage change based on a signal difference measured by the voltage monitor at the connecting point after a first predetermined short period of time of a first timing and a second predetermined short period of time of a second timing have elapsed; and judging as to whether the driver in the printing head actuating circuit is normal or not by comparing said voltage change with a predetermined reference value.

15. A burning damage protecting method for a printing head in accordance with claim 14 further comprising:

a step of prohibiting electric current supply to the printing head actuating circuit; and a step of giving a warning to indicate abnormal condition when said judging step shows that the driver is in an abnormal condition.

16. A burning damage protecting method for a printing head in a printer having a printing head actuating circuit with a driver and a coil, a headpin-driver actuating electric power source which is connected to the printing head actuating circuit, a voltage monitor connected to the headpin-driver actuating electric power source, and a micro processing unit connected to each of the printing head actuating circuit, the headpin-driver actuating electric power source, and the voltage monitor, said burning damage protecting method comprising the steps of:

turning on the headpin-driver actuating electric power source for a first predetermined short time and subsequently turning it off immediately after the printer is turned on;

measuring a voltage based on a signal fed from the voltage monitor at the timing the headpin-driver actuating electric power source is turned off;

measuring a voltage in the same manner as said measurement after a second predetermined short time has elapsed;

judging whether the driver is normal or not based on the difference between the voltage at the timing the first predetermined time has elapsed and the voltage at the timing the second predetermined time has elapsed; and preventing electric current from flowing in the coil by not turning on the headpin-driver actuating electric power source when an abnormal condition is detected.

* * * * *